United States Patent [19]

Kageyama

[11] Patent Number: 4,968,167

[45] Date of Patent: Nov. 6, 1990

[54] COMBINED WRITING TOOL

[76] Inventor: Shuhei Kageyama, 138, Aza Inutake Oaza, Kujirai Kawagoeshi Saitama Ken, Japan

[21] Appl. No.: 299,713

[22] Filed: Jan. 19, 1989

[51] Int. Cl.[5] ..... B43K 27/12

[52] U.S. Cl. ..... 401/31; 401/109; 401/104

[58] Field of Search ..... 401/31, 32, 82, 83, 401/104, 109, 112, 113

[56] References Cited

U.S. PATENT DOCUMENTS

| | | | |
|---|---|---|---|
| 3,219,016 | 11/1965 | Hechtle | 401/31 |
| 3,225,745 | 12/1965 | Hechtle | 401/31 X |
| 3,301,221 | 1/1967 | Von Arx | 401/31 |
| 4,165,941 | 8/1979 | Kageyama | 401/31 |

*Primary Examiner*—Richard J. Johnson

*Attorney, Agent, or Firm*—Donald D. Mon; David O'Reilly

[57] ABSTRACT

A combined writing tool having a body receiving a plurality of writing shafts. The tubular writing shafts have knocking parts on their ends with a rearward end of the writing shafts being held in a respective tubular part. A partition member is interposed between the writing shafts. A pair of springs are provided between a forward retaining part on the partition member and each of the tubular parts. Retaining flaps formed on each respective tubular part have projections retained in through holes in the body when the head end of a selected writing shaft projects out of the body and is retained in a second through hole when a selected body of a writing shaft is withdrawn.

7 Claims, 10 Drawing Sheets

COMBINED WRITING TOOL

BACKGROUND OF THE INVENTION (1) Field of the Invention

This invention relates to a combined writing tool of a mechanical pencil and a ball-point pen, of plural mechanical pencils from different lead diameters and/or lead colors with each other, and of plural ball-point pen with different ball diameters and/or ink colors, and in particular a thin-shaped combined writing tool.

(2) Description of the Prior Art

A conventional combined writing tool comprises a body and two ball-point pens with different colors with each other and a rotation cam mechanism including a can body, a rotation cam, and a cam bar wherein a head of one ball-point pen can be projected out of the forward end of the body alternately with the action of the rotation cam mechanism by knocking operation.

However, the conventional combined writing tool does not include only the mechanism for projecting the head of a ball-point pen out of the forward end of the body alternately by a knocking operation and does not have a mechanism for feeding lead out of a head of a mechanical pencil shaft. Further, because of the complicated construction of the rotation cam mechanism, it is impossible to select desired writing shaft promptly and also it is difficult to form a thin-shaped combined writing tool.

BRIEF SUMMARY OF INVENTION

Accordingly, it is an object of the present invention to provide a combined writing tool wherein it is possible to feed lead out of a head of mechanical pencil shaft.

It is a further object of the present invention to provide a combined writing tool wherein it is possible to select and project quickly the head of the desired writing shaft.

The above objects can be attained by a combined writing tool having a body receiving plural writing shafts, stem of tubular parts have knocking parts on their ends with a rearward end of the writing shafts being held in each of the respective tubular parts. A partition member is interposed between the writing shafts. A pair of springs are provided between a forward retaining part on the partition member and each of the tubular parts. Retaining flaps formed on each respective tubular parts have projections retained in through holes in the body when the head end of a selected writing shaft projects out of the body; and retained in a second through hole when a selected body of a writing shaft is withdrawn.

It is a further object of the present invention to provide a combined writing tool whose assembly is easy.

The above object is achieved with the combined writing tool of the previous embodiment described above, and in addition, including a clip connected to the rearward end of the partition member, has raised parts for pushing the projections out of the first and second through holes to dislodge them. The raised parts are formed on the underside of a forward portion of the clip. The forward end of the retaining portion of the partitions member is further characterized by slots in opposite sides (FIG. 17*a*).

It is a further object of the present invention to provide a combined writing tool wherein the exchange of writing shafts can be easily carried out.

The above object is achieved with the combined writing tool of the previous embodiment described herein above and in addition including second raised portions on the underside of the clip for dislodging the projection parts retained in the second of the through holes.

DETAILED DESCRIPTION OF THE DRAWINGS

Figure 1:
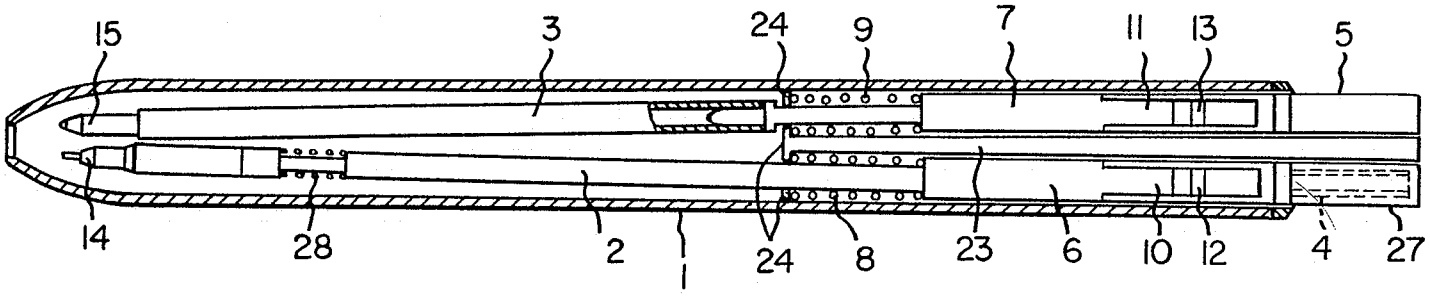
FIG. 1 is a cross-sectional view showing an embodiment of a combined writing tool according to the present invention, said combined writing tool including a first and a second writing shaft.
Figure 2:
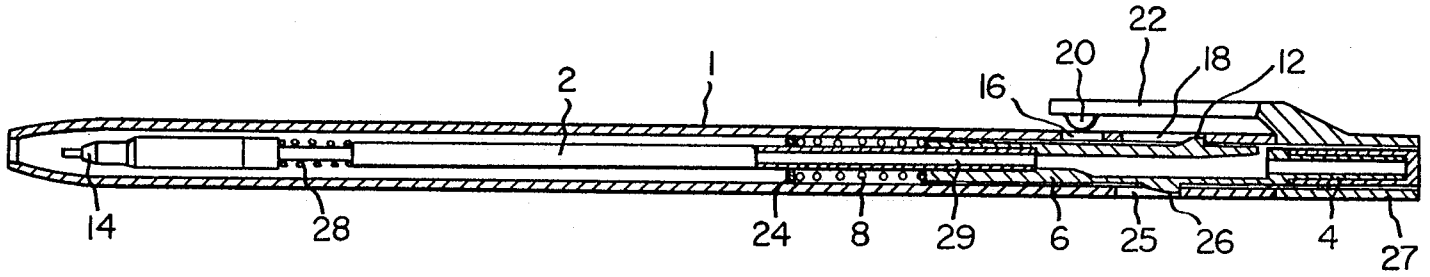
FIG. 2 is a sectional side elevation showing the first writing shaft.
Figure 3:
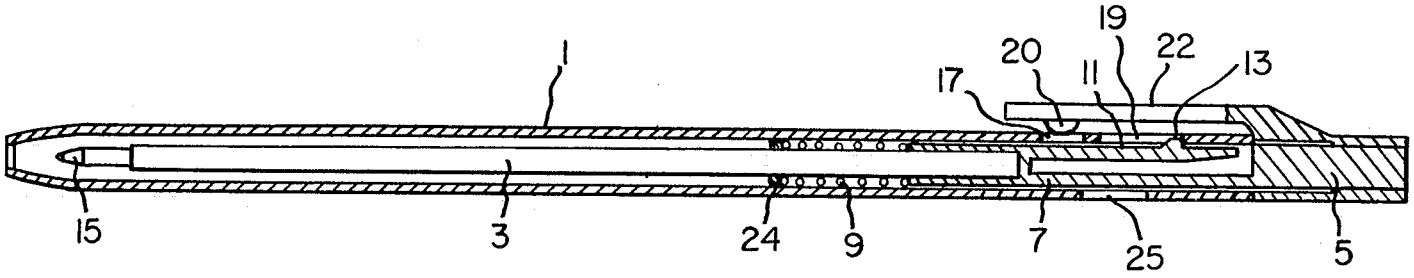
FIG. 3 is a sectional side elevation showing the second writing shaft.
Figure 4:
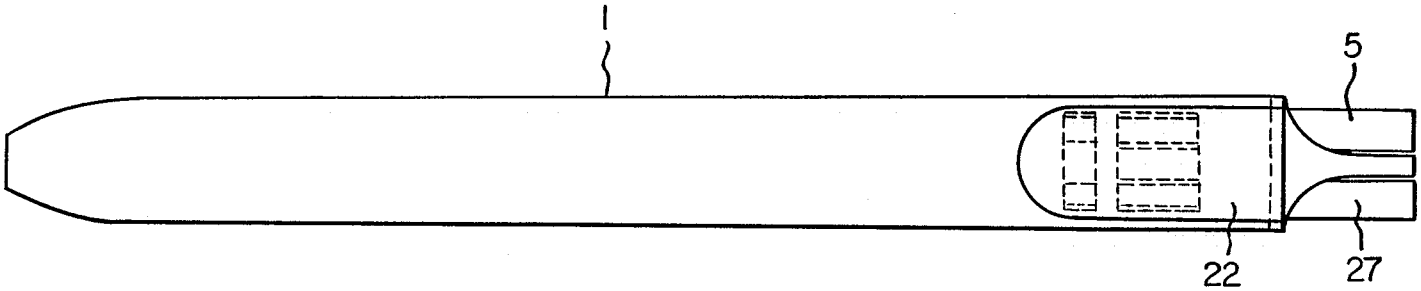
FIG. 4 is an elevational view of the above embodiment.

Referring first to the embodiment of the invention shown in FIGS. 1–3, numeral 1 designates a thin-shaped body, and numerals 2 and 3 are two writing shafts inserted in the body. In this embodiment first writing shaft 2 is a shaft for a mechanical pencil, while second writing shaft 3 is a shaft for a ball-point pen. However, in the present invention, these writing shafts may be instead one shaft for a first mechanical pencil and the other shaft for a second mechanical pencil which differs from the first mechanical pencil in the lead diameter and/or the lead color, or one shaft for a first ball point pen and the other shaft for a second ball-point pen which differs from the first ball-point pen in the ball diameter and/or the ink color.

Further, in the present invention, the number of writing shafts is not limited to two.

Figure 5A:
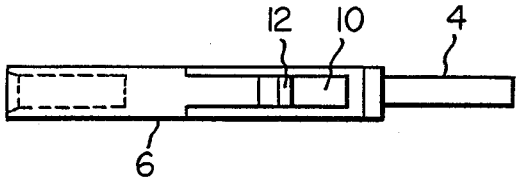
FIGS. 5(*a*), (*b*) shows the knocking part of the mechanical pencil of the present invention, (*a*) being a plan view, (*b*) being a vertical section, respectively, FIGS. 6(*a*), (*b*) show the knocking part of a ball-point pen in the present invention, (*a*) being a plan view, (*b*) being a vertical section, respectively, FIGS. 7(*a*)–(*c*) show an illustration of the partition in the present invention, (*a*) being a plan view, (*b*) being a side view, (*c*) being a bottom view, respectively.
Figure 5B:
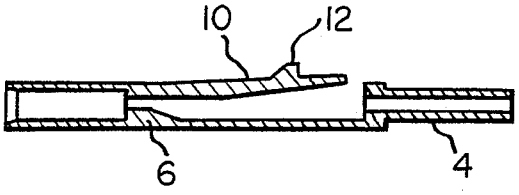
Figure 6A:
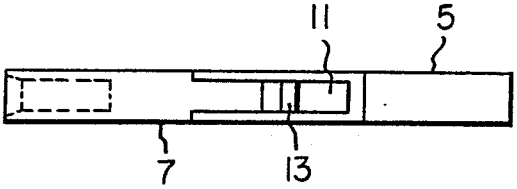
Figure 6B:
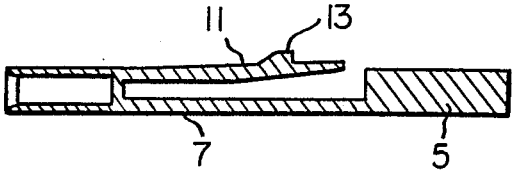

Tubular parts 6, 7 of knocking parts 4, 5 (refer to FIGS. 5 and 6) are mounted on the rear part of the writing shafts 2, 3. A knock cap 27 is put on the portion of the knocking part 4 which is projected out of the body 1. It is convenient for selectively using the writing shaft 2 for a mechanical pencil and the writing shaft 3 for a ball-point pen to color the knocking cap 27 for a mechanical pencil in the different color from which the color of the knocking part 5 for a ball-point pen. The knock cap for a mechanical pencil prevents leads in a lead tank 29 of the writing shaft 2 from getting out of the rear part of the writing shaft 2. Besides it can be very easily carried out to supply lead by removing the knock cap 27.

Figure 8:
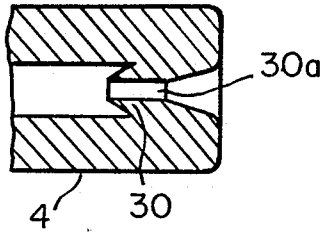
FIG. 8 is a partly diagrammatic sectional view.

However, the knock cap 27 is not always necessary: As shown in FIG. 8, a lead hole 30*a* has the minimal diameter through which lead can pass without difficultly and an annular wedged part 30 is formed around the inner terminal of the lead hole 30*a* wherein said annular wedged part has wedged cross-section and wherein the pointed end of said wedged cross-section is directed towards the forward part of the lead tank 29, by which the lead hole 30*a* can be prevented from getting out of the lead tank 29 while lead can be supplied into the lead tank 29 through the lead hole 30*a*.

Figure 7A:
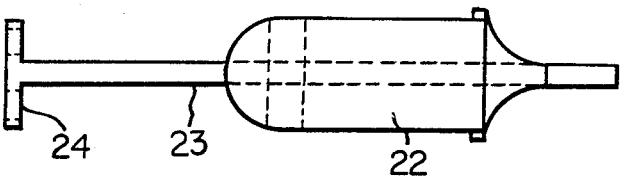
Figure 7C:
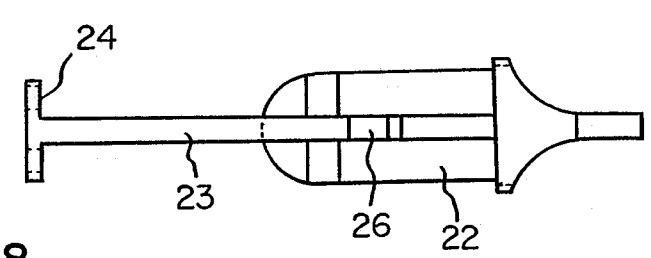
Figure 7B:
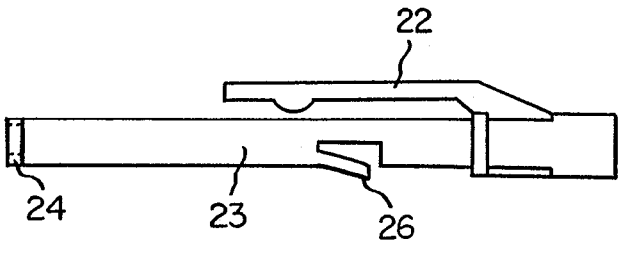

The body 1 is provided with a partition member 23 (refer to FIGS. 1 and 7) in said body 1 which partially divides the inner space of the body 1 into two sections, one section for the first writing shaft 2 and the other section for the second writing shaft 3. The partition member 23 is provided both with a forward receiving part 24 having through holes through each of which the writing shaft 2 or 3 passes at the forward part of the partition 23 and with a clip 22 at the rear part of the partition 23. An elastic body, for example springs 8, 9 for pushing backward the writing shafts 2, 3 are provided between the forward receiving part 24 of the partition member 23 and the tubular parts 6, 7 of the knocking parts 4, 5.

Each tubular part 6, 7 has a retaining flap 10, 11 each with a projection 12, 13 (refer to FIGS. 5 and 6), respectively, while first through holes 16, 17 and second through holes 18, 19 are formed at the rear part of the body 1, with the former being arranged at the position corresponding to the projection 12 or 13 of the writing shaft 2 or 3 whose head 14 or 15 is projected out of the forward part of the body 1 and the latter being arranged at the position corresponding to the projection 12 or 13 of the writing shaft 2 or 3 whose head 14 or 15 is drawn in the body. When head 14 or 15 of the writing shaft 2 or 3 is projected out of the forward part of the body 1, the projection 12 or 13 of the tubular portion 6 or 7 can be retained by the first through hole 16 or 17, respectively. On the other hand, when the head 14 or 15 of the writing shaft 2 or 3 is drawn in the body 1, the projection 12 or 13 of the tubular portion 6, 7 can be retained by the second through hole 18 or 19. The forward inner surface of the clip 22 of the partition member 23 is provided with a raised part 20 for pushing out the projection 12 or 13 which has been retained in the first through hole 16 or 17 or the second through hole so that the projection 12 or 13 can be released from said first through hole 18 or 19.

Further, the body 1 has a retaining hole 25, while the partition member 23 has a retaining part 26 (FIGS. 2 and 7) which is retained in the retaining hole 25. The retaining part 26, which is retained in hole 25, prevents the partition member 23 from slipping out of the body backwards. Of course, the partition member 23 and the clip 22 are hard to be slipped out of the body 1 with the spring force of the springs 8, 9 without the retaining part 26 and the retaining hole 25, even though the force in the backward direction is applied on the partition member 23 or the clip 22, because the combined writing tool of the present embodiment includes the retaining flaps 10, 11 with the projections 12, 13 in the middle and the tubular part 6, 7 in the front on both sides of the partition member 23 with the receiving part 24 and the springs 8, 9 is provided between the receiving part 24 of the partition member 23 and each tubular part 6, 7 respectively. However, considering the force which can be opposed to the spring force of the springs 8, 9 the combined writing tool may be provided with any other means such as rib instead of the retaining part 26 and the retaining hole.

The combined writing tool of the present embodiment functions as follows.

With a view to selecting and using desired writing shaft, the knocking part 4 for the writing shaft, for example the writing shaft 2 for a mechanical pencil is knocked against the spring force of the spring 8, by which the projection 12 is released from the second through hole 18, then thw writing shaft 2 is moved forwards, and the projection 12 is retained in the first through hole 16 so that the writing shaft 2 projected can be held to the body 1.

With a view to drawing in the head 14, the forward end of the clip 22, by which the projection 12 which has been retained in the the first through hole 16 is pushed out by the raised part 20 so that the projection 12 can be released from the first through hole. Consequently, the writing shaft 2 is moved backwards with the spring force of the spring 8 so that the head 14 can be drawn in the body 1, wherein the projection 12 is retained in the second through hole 18 so that the writing shaft 2 drawn in can be held to the body.

Therefore, there is not danger of the writing shaft 2 slipping out of the rearward part of the body 1.

Under the condition that the head 14 of the writing shaft 2 for a mechanical pencil is projected out of the forward end of the body 1, if knocking operation of the knocking part 4 is carried out in such a manner as the conventional mechanical pencil, a chuck in a chuck ring is moved forward or backward against a spring 28 of the writing shaft 2 for making the chuck shut 2 or with its spring force so that the chuck in a chuck ring can be opened or shut, by which lead can be sent out from the forward end 14 of the body 1.

On the other hand, in selecting using the other writing shaft, that is the shaft for ball-point pen, it is possible to project the head 15 of the writing shaft 3 out of the forward part 15 of the body 1 in such a manner as the above case and to use a ball-point pen. Further, the head 15 of the writing shaft can be drawn in such a manner as the above case by pushing the top of the clip 22.

In this embodiment, in case of the writing shafts 2, 3 being removed on account of the damage of the writing shafts 2, 3, or on account of the writing shafts 2, 3 being defective or on account of ink being exhausted, etc., the partition member 23 is drawn backwards until the raised part 20 is opposed to the second through hole 18, 19, then the forward end of the clip 22 is pushed, thereby the projections 12, 13 which have been retained in the second through holes 18, 19 being pushed by the raised part 20, with the retaining flaps 10, 11 being bent so that the projections 12, 13 can be released from the second through holes 18, 19. Under this condition, the retaining part 26 is released from the retaining hole 25 by pushing said retaining part 26, for example, with a jig so that the writing shafts 2, 3 can be drawn out of the rearward end of the body 1 along with the tubular bodies 6, 7 and the partition 23 member.

If the retaining part 26 takes the shape of a hump without taking the stepped shape as shown in FIG. 2, the retaining part 26 can be easily released from the retaining hole 25 by pulling backwards the writing shafts 2, 3 along with the tubular bodies 6, 7 and the partition 23 without using a jig.

From the standpoint of molding, the configuration of the body 1 having the retaining hole 25 and the first and second through holes 16, 17, 18, 19 is advantageous because bending of a core pin for forming the inside of the body 1 which is caused by injection pressure during molding can be prevented with side pin, therefore there being no danger of uneven thickness being formed.

In case of the body being not provided with the retaining hole 25 and the retaining part 26, the partition member 23 is drawn backwards until the raised part 20 is opposed to the second through hole 18, 19, then the forward end of the clip 22 is pushed, thereby the projections 12, 13 which have been retained in the second through holes 18, 19 being pushed by the raised part 20, with the retaining flaps 10, 11 being bent so that the projections 12, 13 can be released from the second through holes 18, 19. In this condition, the retaining part 26 is released from the retaining hole 25.

As is obvious from the above description, it is possible to send lead out of the forward end of the body 1, because it is possible to knock the knocking part 4, 5 of each writing shaft 2, 3 independently of each other to project the head of each writing shaft 2, 3 out of the forward end of the body 1.

Further, as the rotation cam mechanism is not used, it is possible to produce a combined writing tool which has a simple and low-priced construction and in which quick selection of the desired writing shaft is possible. Besides, according to the invention, it is possible to provide a thin-shaped combined writing tool.

Then a second embodiment according to the present invention is illustrated.

Referring to the embodiment of the invention shown in FIGS. 9–14, numeral 1 designates a thin-shaped body, and numerals 2 and 3 are two writing shafts inserted in the body 1. In this embodiment one writing shaft 2 is a shaft for a mechanical pencil, while another writing shaft 3 is a shaft for a ball-point pen. However, in the present invention, these writing shafts may be instead one shaft for a first mechanical pencil and the other shaft for a second mechanical pencil which differs from the first mechanical pencil in the lead diameter and/or the lead color, or one shaft for a ball-point pen and the other shaft for a second ball-point pen which differs from the first ball-point pen in the ball diameter and/or the ink color.

Further, in the present invention, the number of writing shafts is not limited to two.

Figure 15A:
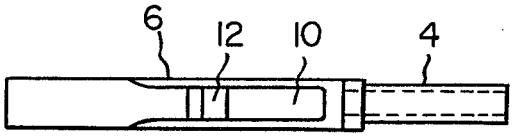
FIGS. 15(*a*), (*b*) show the knocking part of the mechanical pencil of the present invention, (*a*) being a plan view, (*b*) being a vertical section, respectively, FIGS. 16(*a*), (*b*) show the knocking part of the ball-point pen of the present invention, (*a*) being a plan view, (*b*) being a vertical section, respectively, FIGS. 17(*a*)–(*c*) shows an illustration of the partition of the present invention, (*a*) being a plan view, (*b*) being a side view, (*c*) being a bottom view, respectively, FIGS. 18(*a*), (*b*) are a left-hand side view and a right-hand side view of FIG. 17(*b*), respectively, FIGS. 19(*a*)–(*c*) are a sectional view taken along the line X I a—X I a of FIG. 17(*b*), a sectional view taken along the line X I b—X I b of FIG. 17(*b*), and a sectional view taken along the line X I c—X I c of FIG. 17(*b*), respectively, FIGS. 20(*a*), (*b*) are front views of the clips in other embodiments, respectively.
Figure 15B:
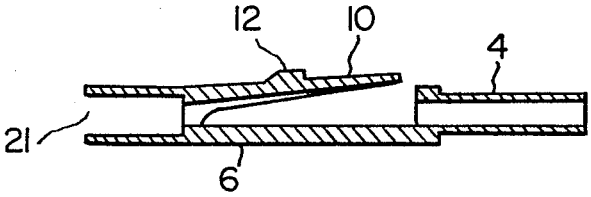
Figure 16A:
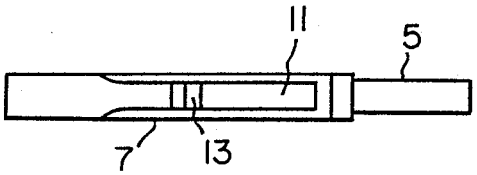
Figure 16B:
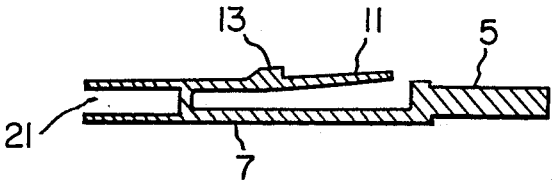
Figure 17A:
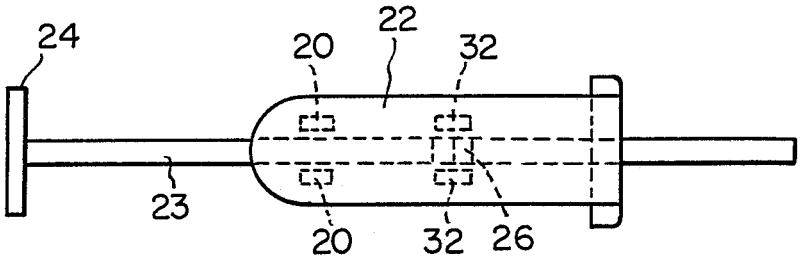
Figure 17B:
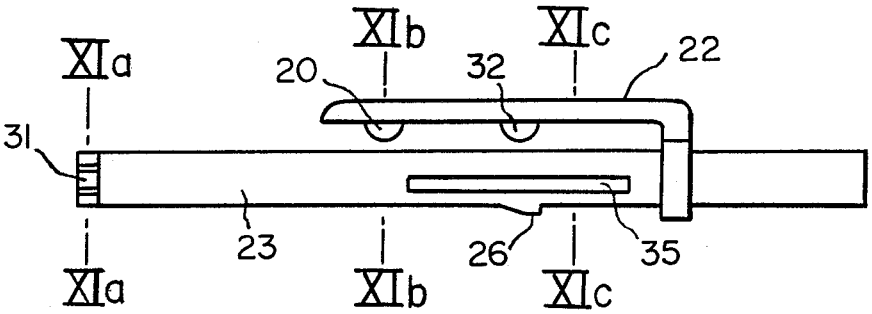
Figure 18A:
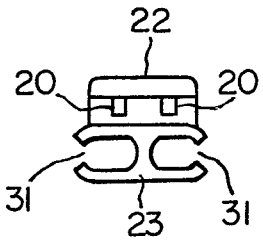
Figure 18B:
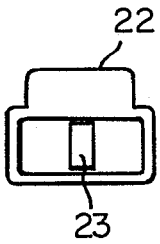
Figure 19A:
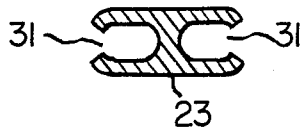
Figure 19B:
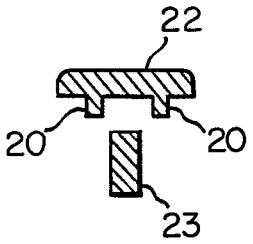
Figure 19C:
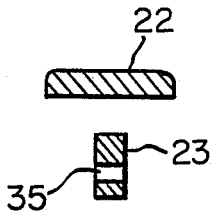

Tubular parts 6, 7 of knocking parts 4, 5 (refer to FIGS. 15 and 16) are mounted on the rear part of the writing shafts 2, 3. A knock cap 27 is put on the portion of the knocking part 4 which is projected out of the body 1. It is convenient for selectively using the writing shaft 2 for a mechanical pencil and the writing shaft 3 for a ball-point pen to color the knocking cap 27 for a mechanical pencil in the different color from which the color of the knocking part 5 for a ball-point pen. Herein in case of a ball-point pen, a knocking part 5 may be formed integrally with the knock cap 27 with a view to decreasing number of parts, or the knocking part 5 may be provided with a through hole as shown in FIG. 15 to give interchangeability with a mechanical pencil. The knock cap 27 for a mechanical pencil prevents leads in a lead tank 29 of the writing shaft 2 from getting out of the rear part of the writing shaft 2. Besides it can be very easily carried out to supply lead by removing the knock cap 27.

The body 1 is provided with a partition member 23 (refer to FIGS. 9 and 17–19) in said body 1 which partially divides the inner space of the body 1 into two sections, one section for the first writing shaft 2 and the other section for the second writing shaft 3. The partition member 23 is provided both with a receiving part 24 having through holes through each of which the writing shaft 2 or 3 passes at the forward part of the partition 23 and with a clip 22 at the rear part of the partition 23. An elastic body, for example springs 8, 9 for pushing backward the writing shafts 2, 3 are provided between the receiving part 24 of the partition member 23 and the tubular parts 6, 7 of the knocking parts 4, 5.

Each tubular part 6, 7 has a retaining flap 10, 11 each with a projection 12, 13 (refer to FIGS. 15 and 16), respectively, while first through holes 16, 17 and second through holes 18, 19 are formed at the rear part of the body 1, with the former being arranged at the position corresponding to the projection 12 or 13 of the writing shaft 2 or 3 whose head 14 or 15 is projected out of the forward part of the body 1 and the latter being arranged at the position corresponding to the projection 12 or 13 of the writing shaft 2 or 3 whose head 14 or 15 is drawn in the body. When head 14 or 15 of the writing shaft 2 or 3 is projected out of the forward part of the body 1, the projection 12 or 13 of the tubular portion 6 or 7 can be retained by the first through hole 16 or 17, respectively. On the other hand, when the head 14 or 15 of the writing shaft 2 or 3 is drawn in the body 1, the projection 12 or 13 of the tubular portion 6, 7 can be retained by the second through hole 18 or 19. The clip 22 of the partition member 23 is provided with raised parts 20, 32 for pushing out the projection 12 or 13 which have been retained in the first through hole 16 or 17 or the second through hole so that the projection 12 or 13 can be released from said first through hole 18 or 19, at the forward inner surface and at the middle inner surface, respectively.

A slit 21 is formed at both sides of the tubular parts 6, 7 in each writing shaft 2, 3 and a slit 31 is formed at side part of the receiving part of the partition 23 (refer to FIGS. 15–19). The slit 21 at both sides of the tubular parts 6, 7 is not always neccesary, however it is desirable provide the tubular part 6, 7 with the slit 21 because the slit 21 facilitates the insertion of each writing shaft 2, 3 into the tubular part 6, 7 therefore assembling being easy.

Further, the body 1 has a retaining hole 25, while the partition member 23 has a retaining part 26 (FIGS. 12, 13 and 17) which is retained in the retaining hole 25. In this embodiment, the partition member 23 is provided with a through hole 35 which passes through the partition member 23 in the traverse direction and the portion of the partition member 23 including the through hole 35 is provided with the retaining part 26 opposite to the retaining hole 25 wherein retaining of the retaining part 26 in the retaining hole 35 and the release of the former from the latter can be positively performed. The retained in part 26, which is retaining hole 25, prevents the partition member 23 from slipping out of the body backwards. Of course, the partition member 23 and the clip 22 are difficult to to slip out of the body 1 with the spring force of the springs 8, 9 without the retaining part 26 and the retaining hole 25, even though the force in the backward direction is applied on the partition member 23 or the clip 22. This is because the combined writing tool of the present embodiment includes the retaining flaps 10, 11 with the projections 12, 13 in the middle and the tubular part 6, 7 in the front on both sides of the partition member 23 with the receiving part 24 and the springs 8, 9 is provided between the receiving part 24 of the partition member 23 and each tubular part 6, 7 respectively. However, considering the force which can be opposed to the spring force of the springs 8, 9 the combined writing tool may be provided with any other means such as rib instead of the retaining part 26 and the retaining hole.

The combined writing tool of the present embodiment functions as follows.

Figure 9:
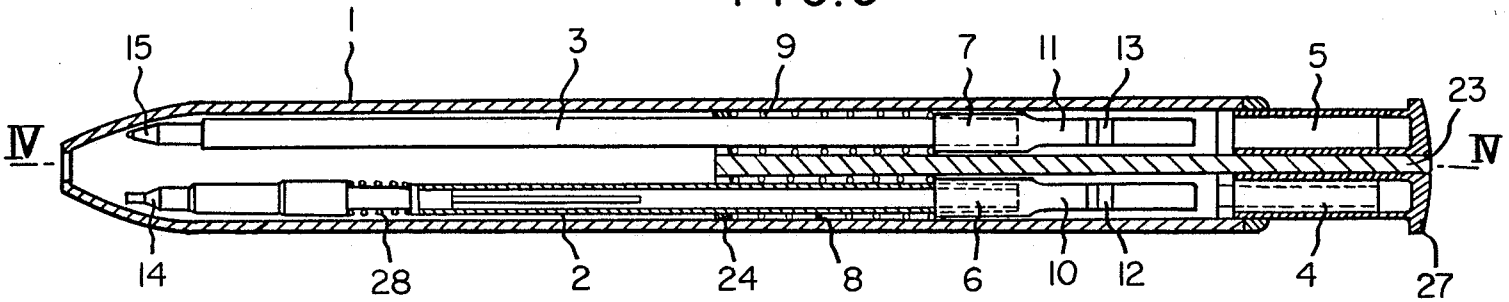
FIG. 9 is a cross-sectional view showing a second embodiment of a combined writing tool according to the present invention, said combined writing tool including a first and a second shaft, FIGS. 10(*a*), (*b*) are sectional side elevations showing the first writing shaft, (*a*) showing the condition when said shaft is drawn in and (*b*) showing the condition when said shaft is projected, FIGS. 11(*a*), (*b*) are sectional side elevations showing the second writing shaft, (*a*) showing the condition when said shaft is drawn in and (*b*) showing the condition when said shaft is projected.
Figure 10A:
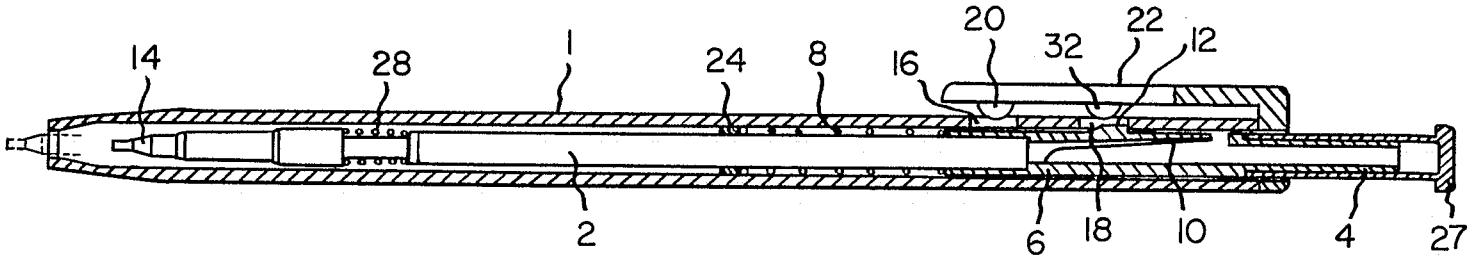
Figure 10B:
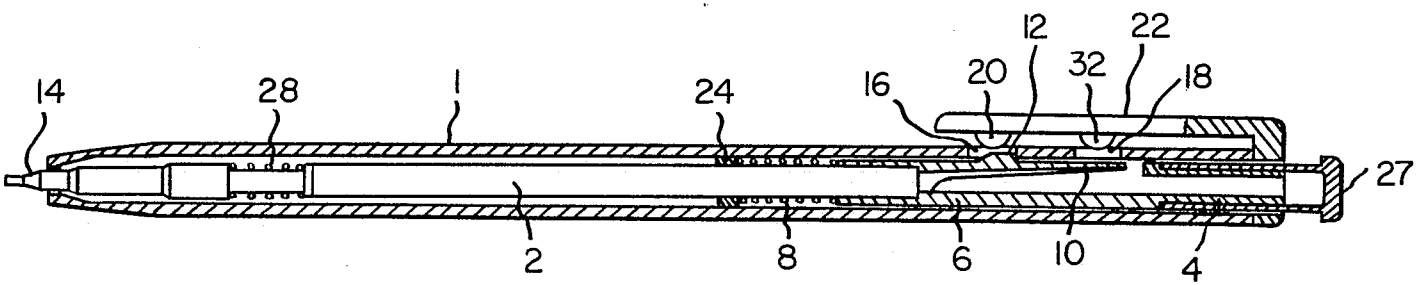
Figure 11A:
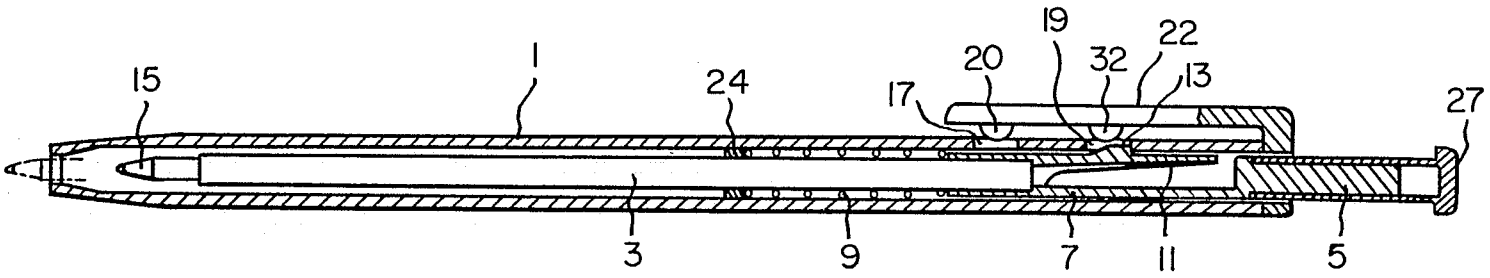
Figure 11B:
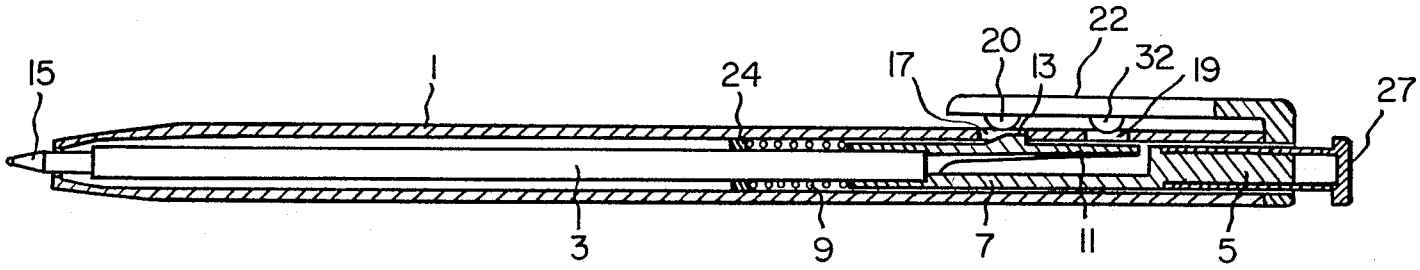

With a view to selecting and using desired writing shaft, the knocking part 4 for the writing shaft, for example the writing shaft 2 for a mechanical pencil is knocked against the spring force of the spring 8, by which the projection 12 is released from the second through hole 18, then thw writing shaft 2 is moved forwards, and the projection 12 is retained in the first through hole 16 so that the writing shaft 2 projected can be held to the body 1 (refer to FIG. 9(*b*).

With a view to drawing in the head 14, the forward end of the clip 22, by which the projection 12 which has been retained in the the first through hole 16 is pushed out by the raised part 20 so that the projection 12 can be released from the first through hole. Consequently, the writing shaft 2 is moved backwards with the spring force of the spring 8 so that the head 14 can be drawn in the body 1, wherein the projection 12 is retained in the second through hole 18 so that the writing shaft 2 drawn in can be held to the body (refer to FIG. 9(*a*).

Therefore, there is no danger of the writing shaft 2 slipping out of the rearward part of the body 1.

Under the condition that the head 14 of the writing shaft 2 for a mechanical pencil is projected out of the forward end of the body 1, if knocking operation of the knocking part 4 is carried out in such a manner as the conventional mechanical pencil, a chuck in a chuck ring is moved forward or backward against a spring 28 of the writing shaft 2 for making the chuck shut 2 or with its spring force so that the chuck in a chuck ring can be opened or shut, by which lead can be sent out from the forward end 14 of the body 1.

On the other hand, in selecting using the other writing shaft, that is the shaft for a ball-point pen, it is possible to project the head 15 of the writing shaft 3 out of the forward part 15 of the body 1 in such a manner as the above case and to use a ball-point pen. Further, the head 15 of the writing shaft can be drawn in such a manner as the above case by pushing the top of the clip 22.

The slit 31 which is provided in the side of the forward receiving part 24 of the partition member 23 also facilitates the bending in the transverse direction of the writing shaft. Therefore, it is possible to smoothly project or draw the head 14, 15 of the writing shaft 2, 3 from the forward end of the body 1. Further, the slit 21 which is provided in the side of each tubular part 6, 7 more facilitates the bending in the traverse direction of the writing shaft 2, 3. Therefore, it is possible to more smoothly project or draw the head of each writing shaft 2, 3 from the forward end of the body 1.

In this embodiment, in case of the writing shafts 2, 3 being removed on account of damage to the writing shafts 2, 3, or on account of the writing shafts 2, 3 being defective, or on account of ink being exhausted, etc., the partition member 23 is drawn backwards until the raised part 20 is opposed to the second through hole 18, 19, then the forward end of the clip 22 is pushed, thereby the projections 12, 13 which have been retained in the second through holes 18, 19 are pushed by the raised part 20, with the retaining flaps 10, 11 being bent so that the projections 12, 13 can be released from the second through holes 18, 19. Under this condition, the retaining part 26 is released from the retaining hole 25 by pushing said retaining part 26, for example, with a jig so that the writing shafts 2, 3 can be drawn out of the reaward end of the body 1 along with the tubular bodies 6, 7 and the partition 23 member.

Figure 12:
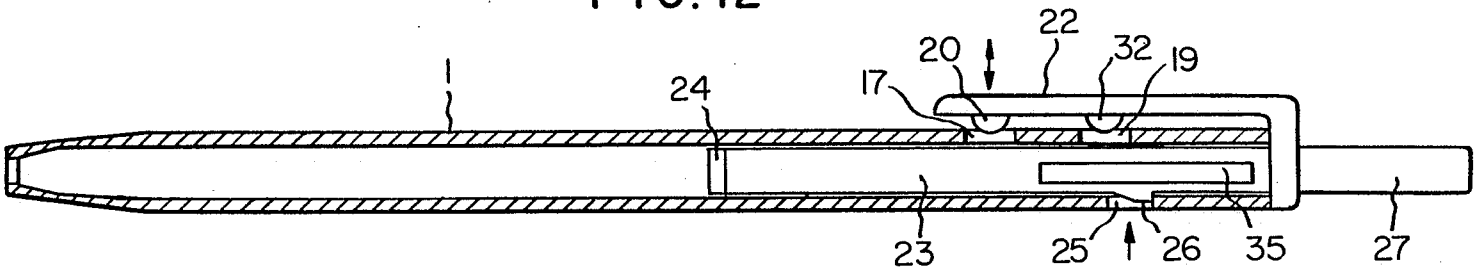
FIG. 12 is an elevational view of the above embodiment taken along the line IV—IV shown in FIG. 9.
Figure 14A:
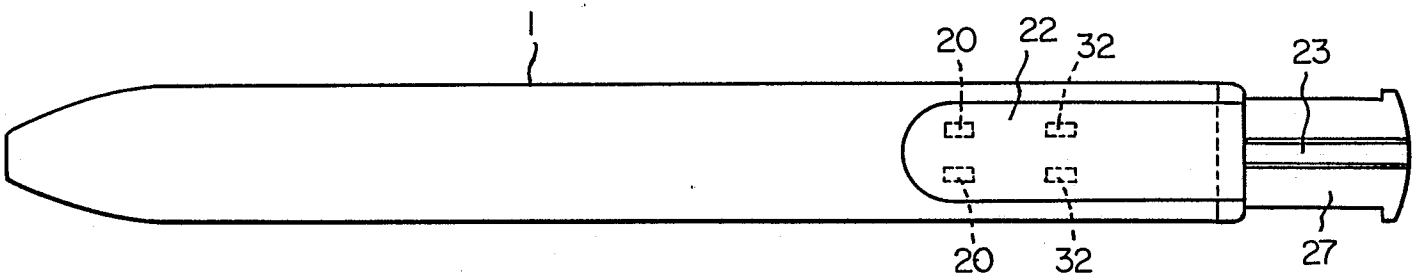
Figure 14B:
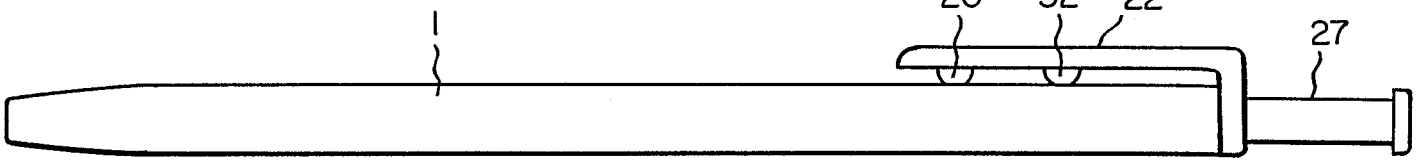
Figure 13:
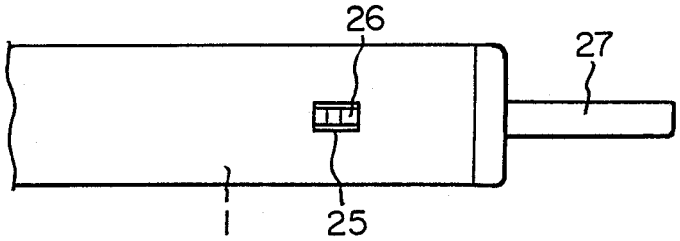
FIG. 13 is a bottom view of the backward part of the embodiment shown in FIG. 12, FIGS. 14(*a*), (*b*) are a front view, a side view of of the above embodiment, respectively.

If the retaining part 26 takes the shape of hump without taking the stepped shape as shown in FIG. 12, the retaining part 26 can be easily released from the retaining hole 25 by pulling backwards the writing shafts 2, 3 along with the tubular bodies 6, 7 and the partition 23 without using a jig.

From the standpoint of molding, the configuration of the body 1 having the retaining hole 25 and the first and second through holes 16, 17, 18, 19 is advantageous because bending of a core pin for forming the inside of the body 1 which is caused by injection pressure during molding can be prevented with side pin, therefore there being no danger of uneven thickness being formed.

In case of the body being not provided with the retaining hole 25 and the retaining part 26, the partition member 23 is drawn backwards until the raised part 20 is opposed to the second through hole 18, 19. Then the forward end of the clip 22 is pushed, whereby the projections 12, 13 which have been retained in the second through holes 18, 19 are pushed by the raised part 20, with the retaining flaps 10, 11 being bent so that the projections 12, 13 can be released from the second through holes 18, 19. In this condition, the retaining part 26 is released from the retaining hole 25.

Figure 20A:
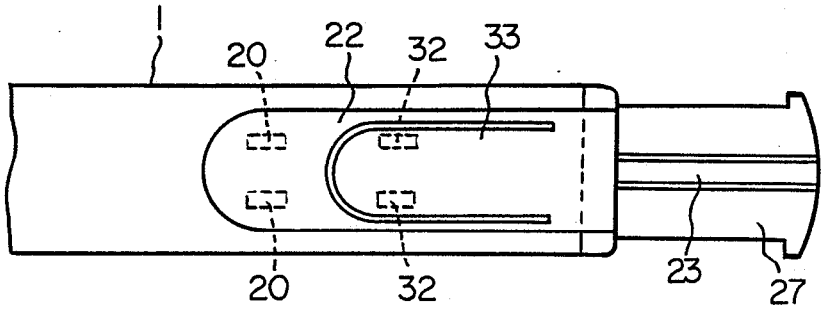
Figure 20B:
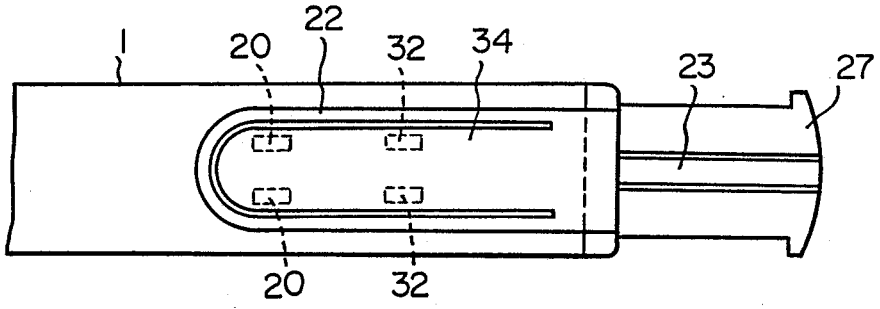

FIGS. 20(*a*), (*b*) are front views showing clips in other embodiments, (*a*) illustrating a clip wherein said clip is provided with a tongue 33 which has raised part 32 at the inside thereof, (*b*) illustrating a clip wherein said clip is provided with a tongue 34 which has first raised parts 20 at the inside of the forward part of the tongue 34 and second raised part 32 at the inside of the middle part of the tongue 34.

In the embodiment shown in FIG. 20(*a*), the release of the projections 12, 13 from the second through holes 18, 19 can be performed by pushing the raised part 32 of the tongue 33 toward the projections 12, 13, with pushing and bending the tongue 33, so that the projections 12, 13 can be released from the second through holes 18, 19, the writing shafts 2, 3 being able to be drawn from the rear end of the body, along with the tubular parts 6, 7 and the partition member 23.

In the embodiment shown in FIG. 20(*b*), the release of the projections 12, 13 from the first through holes 16, 17 can be performed by pushing the raised parts 20 and 32 toward the first through holes 16, 17 and the second through holes 18, 19, with pushing and bending the tongue 34, so that the projections 12, 13 can be released from the first through holes 16, 17 or the second through holes 18, 19, the writing shafts 2, 3 being able to be drawn from the backward end of the body, along with the tubular parts 6, 7 and the partition member 23.

Further with a view to facilitating the retaining of the projections 12, 13 with the second through holes 18, 19 the backward edge of the second through holes 18, 19 may have such a slope that the projections 12, 13 can easily get in or out of the second through holes or, opened slips may be provided in the backward end of the writing shaft behind the second through holes 18, 19 so that the projections 12, 13 can easily get in or out of the second through holes.

As is obvious from the above description, it is possible to produce a combined writing tool which can be assembled easily as compared with conventional combined writing tool, because the side portion of the tubular part 6, 7 in which at least the side portion of the forward receiving part 24 of the partition member 23 is provided with a slit 31 and when the side portion of the forward receiving part 24 of the partition member 23 is provided with a slit 31 and also the side portion of each tubular part 6, 7 is provided with the slit 21, it is possible to to produce a combined writing tool which can be more easily assembled. Besides, in the former, the head 14, 15 of each writing shaft 2, 3 can be smoothly projected of or drawn in the forward end of the body 1, because the slit 31 allows each writing shaft 2, 3 to easily bend, and also in the latter, the head 14, 15 of each writing shaft 2, 3 can be more smoothly projected out of or drawn in the forward end of the body because the slit 31 and the slit 21 allow each writing shaft 2, 3 to more easily bend.

Further, with the raised part 32 for releasing the projection 12, 13 from the first or second through holes 16, 17 or 18, 19, it is possible to release the projection 12, 13 from the first or second through holes 16, 17 or 18, 19 to pull out the writing shafts 2, 3 along with the tubular parts 6, 7 and the partition on member 23 in case of the writing shafts 2, 3 being removed on account of the damage of the writing shafts 2, 3, or on account of the writing shafts 2, 3 being defective, or on account of ink being exausted, etc.

I claim:

1. A combined writing tool comprising; a tubular body, a plurality of writing shafts inserted in said body each having a head writing end extendible from one end of said tubular body; plural tubular knocking member mounted on a rearward ends of each of said writing shafts; each of said tubular knocking members having a knocking part; a partitioning member interposed between and separating each of said writing shafts; a forward end of said partition having a receiving and retaining part; a plurality of springs positioned between said forward receiving part of said partitioning member and an abutment on each of said respective tubular knocking members; resilient retaining flaps respectively formed on a rearward end of said tubular knocking members; said resilient retaining flaps including raised projections respectively formed thereon; a first through hole in said tubular body constructed to receive and retain one of said projections of a writing shaft when a writing head end is extended and a second through hole in said tubular body constructed to receive and retain projections on other writing shafts withdrawn into said body; release means integrally forward on said partitioning member for dislodging said projections from said first or second through holes.

2. The combined writing tool according to claim 1 including a clip integrally formed on said partition member.

3. The combined writing tool according to claim 2 in which said release means comprises at least one protuberance on the underside of said clip.

4. The combined writing tool according to claim 1 in which said partitioning member includes a retaining catch; said tubular body having a catch retaining hole for receiving said retaining catch.

5. The combined writing tool according to claim 3 in which at least one protuberance is formed on the underside of the forward end of said clip whereby said protuberance can release the projection engaging said first through hole to withdraw an extended head of one of said plurality of writing shafts.

6. The combined writing tool according to claim 5 in which said partitioning member includes a retaining catch; said tubular body having a catch retaining hole for receiving said retaining catch.

7. The combined writing tool according to claim 4 includes a longitudinal through hole traversing said partition member; said retaining catch being formed on a resilient portion bridges said longitudinal through hole.

* * * * *